United States Patent [19]

Gardos et al.

[11] Patent Number: 5,035,836

[45] Date of Patent: Jul. 30, 1991

[54] SOLID LUBRICATED RESISTIVE INK FOR POTENTIOMETERS

[75] Inventors: Michael N. Gardos, Los Angeles; Larry C. Lipp, Torrance; William S. Griffin, Manhattan Beach, all of Calif.

[73] Assignee: Hughes Aircraft Company, Los Angeles, Calif.

[21] Appl. No.: 367,914

[22] Filed: Jun. 19, 1989

[51] Int. Cl.[5] ..... H01B 1/06; H01C 1/06; H01C 10/00

[52] U.S. Cl. ..... 252/511; 252/506; 252/502; 252/518; 524/401; 524/406; 524/402; 524/407; 524/435; 524/495; 523/457; 523/458; 523/468; 523/514; 523/515; 523/516; 523/512; 338/68; 338/160

[58] Field of Search ..... 252/511, 502, 506, 518, 252/27-31; 106/20; 338/68, 80, 79, 160, 117, 35; 524/495, 496, 401, 402, 406, 407, 435; 523/457, 458, 468, 514, 515, 516, 512

[56] References Cited

U.S. PATENT DOCUMENTS 4,376,710 3/1983 Gardos et al. ..... 252/12.4
4,701,382 10/1987 Pichart ..... 252/511

OTHER PUBLICATIONS

"Resistors, Capacitors, Networks Special Report" by Electronic Engineering Times, Mar. 26, 1984–Issue 282, 4 pgs.

J. D. van Drumpt, Akzo Chemie America, Noury Chemical Div., Chicago, "Developments in Conductive Carbon Blacks", Plastics Compounding, Mar./Apr. 1988, pp. 37–44.

Bobby D. McConnell, "Solid Lubricating Films Friction-Wear Improvement with Poly(benzothiazole) Binders", Ind. Eng. Chem. Prod. Res. Develop., vol. 9, No. 4, 1970 (pp. 529–534.

R. K. Bayer, T. A. Ezquerra, H. G. Zachmann, etc. "Conductive Pe-carbon Composites by Elongation Flow Injection Moulding", Part 1 Flow-induced Conductivity Profile-high Molecular Weight Matrix, Journal of Materials Science 23 (1988) pp. 475–480.

D. M. Bigg, "The Effect of Thermal Stresses on the EMI (Electromagnetic Interference) Shielding of Conductive Plastics", Polymer Composites, Apr., 1986, vol. 7, No. 2, pp. 69–75.

*Primary Examiner*—Josephine Barr
*Attorney, Agent, or Firm*—M. E. Lachman; W. J. Streeter; W. K. Denson-Low

[57] ABSTRACT

A solid lubricated resistive ink includes solid lubricants which provide self-lubrication of the resistive ink under high vacuum and low moisture conditions. The resistive inks include a polymer-based binder and an electrically conductive solid lubricant which remains electrically conductive and lubricative under low moisture and high vacuum. Effective lubricants include $MoSe_2$, $NbSe_2$, graphite intercalated with bromine and graphite intercalated with a metal chloride. The resistive ink may additionally include carbon.

8 Claims, No Drawings

SOLID LUBRICATED RESISTIVE INK FOR POTENTIOMETERS

This invention was made with United States Government support under Contract No. F04701-83-C-0025 awarded by the Department of the Air Force. The United States Government has certain rights in this invention.

BACKGROUND OF THE INVENTION

1. Field of the Invention

The present invention relates generally to resistive inks which are used as the resistive element in potentiometers. More particularly, the present invention relates to resistive inks which are suitable for use in low moisture and high vacuum environments.

2. Description of Related Art

Potentiometers having an electrical contact wiper which rubs against a resistive element are well known, as described, for example, by G. J. Gormley in the publication entitled "Conductive Plastic Film Precision Potentiometers" in *Electronic Engineering Times,* Issue 282, Mar. 26, 1984. The resistive elements in potentiometers were originally windings of nichrome wire. More recently, these wire-wound resistive elements have been replaced with plastics which are treated to become semi-electro-conductive. The semi-electro-conductive plastics are typically applied to a substrate to form a semi-conductive coating. These plastic coatings are referred to as "resistive inks."

Carbon black has been widely used as an additive which gives the plastic resistive ink its desired semi-electro-conductive character. A problem with the use of a carbon black is its characteristically abrasive nature. The isotropically hard carbon particles cause excessive wear of the mating potentiometer contact as it slides over the resistive ink.

In the past, the abrasiveness of carbon black has been mitigated by blending small amounts of a highly crystalline graphite into the carbon black filled polymer-based resistive ink. The graphite functions as a lubricant because of the preferential accumulation and orientation of low friction graphite basal planes on the ink's surface, due to sliding of the metal alloy wiper contact across the ink surface. As a result, friction and wear of the precious metal contact wire and resistive ink are reduced. This reduction in friction and wear results in low electrical noise and extends the life of the potentiometer. Even though graphite has anisotropic conductivity, the small amounts (typically less than about five weight percent) added to the carbon black filled resistive inks does not adversely affect the electrical performance of the ink. Accordingly, such carbon black filled resistive inks have become quite popular for use in a wide variety of potentiometer applications.

The solid lubrication mechanism of graphite is effective in ambient air, which normally contains more than a 25 volume percent relative humidity. It is believed that the moisture present in the air provides intercalation of the crystalline graphite which renders it a good solid lubricant. However, graphite lubricated potentiometers which are subjected to a vacuum environment become at least as abrasive as the original carbon black filled resistive ink. As a consequence, such resistive ink-operated potentiometers designed for spaceborne uses will have a relatively short operational life due to high rates of wiper abrasion and wear.

As is apparent from the above, there presently is a need to provide improved resistive inks for use in spaceborne potentiometers, wherein the resistive ink will remain lubricated in the high vacuum and low moisture environment of outer space.

SUMMARY OF THE INVENTION

In accordance with the present invention, an improved polymer-based resistive ink is provided, which is self-lubricating even in a low moisture and high vacuum environment. The present invention is based upon the discovery that certain solid lubricants may be incorporated into the resistive ink to provide lubrication under low moisture and high vacuum conditions without adversely affecting the ink's suitability as a resistive element. These solid lubricants include $MoSe_2$, $NbSe_2$ and graphite intercalated with bromine or selected metal chlorides.

The resistive inks utilizing solid lubricants in accordance with the present invention are thermally and environmentally stable within the widest possible operating range of terrestrially vacuum-operated or spaceborne potentiometers. The use of solid lubricants in accordance with the present invention removes many of the problems normally associated with conventional liquid or grease lubricants. For example, liquid and grease lubricants tend to form a thick, highly viscous insulating film at the low temperatures experienced in outer space. The use of solid lubricants in accordance with the present invention removes this problem because solid lubricants are generally not sensitive to the anticipated operating temperatures of the potentiometer, namely, $-200°$ to $+250°$ C. In addition, the contamination problems associated with the evaporation and condensation of lubricating oils or grease are eliminated, because the solid lubricants of the present invention are essentially non-outgassing.

As an additional feature of the present invention, the solid lubricant is uniformly distributed throughout the resistive ink. This eliminates the necessity of continually replenishing the lubricant, as is typically required in oil and grease-based lubrication systems due to their loss by evaporation or migration. In addition, the possibility of any chemical incompatibility between lubricating oils or greases and the elements of the potentiometer is eliminated since their need is obviated by the solid lubricant which is incorporated directly into the resistive ink.

Another problem circumvented by the use of solid lubricants in accordance with the present invention is the formation of high-resistive friction polymer films on the resistive ink's surface. Such polymer films have been known to occur due to polymerization of a liquid lubricant catalyzed by certain precious metal alloys used as the potentiometer contact wiper material.

A further advantage of the present invention is its significantly increased useful life as compared to previously used thin film forms of solid lubrication applied by powder burnishing or sputtering. These thin films, which are typically $NbSe_2$ or $MoSe_2$, have thicknesses ranging from 500 to 2500 angstroms and often wear out before the desired life of the potentiometer is achieved. By distributing the solid lubricant uniformly in the resistive ink in accordance with the present invention, adequate lubrication of the potentiometer element is assured throughout its useful life.

The above discussed and many other features and attendant advantages of the present invention will become better understood by reference to the following detailed description.

DESCRIPTION OF THE PREFERRED EMBODIMENTS

The present invention involves adding an electrically conductive solid lubricant to the resistive ink of a potentiometer to provide adequate lubrication in both air and outer space (i.e. high vacuum) environments.

The solid lubricants in accordance with the present invention may be used to replace the graphite lubricant presently being utilized in a wide variety of a polymer-based resistive inks. Two of the more popular polymers used in resistive inks are diallylphthalate (DAP) resin and phenolic resins. Although these two resins are the preferred resistive ink polymers, the present invention has application to any resistive ink wherein graphite or other solid lubricants have been or can be added to other resins for lubrication. Other suitable resins include, for example, epoxies, acetals and acrylics.

The solid lubricants, in accordance with the present invention, must be capable of maintaining their lubricating qualities under high vacuum conditions ranging up to greater than $1\times10^{-9}$ torr and low moisture conditions where the relative humidity is less than 25 percent. Such lubricants which remain electrically conductive and lubricative under high-vacuum conditions include $MoSe_2$, $NbSe_2$, graphite intercalated with bromine and graphite intercalated with a metal chloride, wherein the metal chloride is $CuCl_2$, $NiCl_2$, $CdCl_2$ or $CrCl_3$. $CdCl_2$ or $CrCl_3$ is preferred as the graphite intercalant because their thermal stabilities in graphite are the highest in the group. For example, the thermal stabilities of $CdCl_2$ and $CrCl_3$ in graphite are approximately 500° and 250° C. respectively, as compared to 150° C. for $CuCl_2$. The high thermal resistance is desirable in order to withstand the conventional curing temperatures normally used for curing DAP resin. In addition, $CdCl_2$ and $CrCl_3$ are the preferred intercalants because they are less likely to promote free radical reactions during the polymerization or curing of the DAP resin. The $CuCl_2$ may be used in the present invention where lower temperatures (i.e. below about 150° C.) are used.

The resistive ink formulation will include the solid lubricant, polymer resin and a solvent. Carbon powder can be added to the formulation to adjust the resistivity as necessary. Various forms of carbon, such as graphite or carbon black, having various resistivities can be used. The ink is prepared by mixing the desired amount of solid lubricant, carbon (when used), and resin together, and then adding sufficient solvent to obtain the desired ink viscosity. The viscosity of the ink will vary depending upon the type of application process utilized. The ink may be applied by spraying, brushing or other suitable application techniques typically used to apply resistive ink films to the potentiometer element substrate. Typical viscosities of the coating dispersion for spraying are such that the dispersion passes through a number 2 Zahn cup in 15 to 20 seconds.

The solvent used to create a suitable dispersion for application can be any of the conventional resistive ink solvents, such as toluene and/or xylene. Methyl ethyl ketone (MEK) and methyl isobutyl ketone (MIBK) may also be added in small amounts to adjust the final viscosity of the diluted resistive ink dispersion. However, some interaction between MEK or MIBK and intercalated graphite has been observed after extended exposure (i.e. longer than one day). Accordingly, if MEK and MIBK are used as ink solvents, they should be added to the ink slurry just prior to spraying.

The weight ratio of the polymer-based binder or resin to the mixture of the electrically conductive solid lubricant and carbon (when used) should be between about 5:1 to 1:1 by weight. When carbon is used, the ratio of carbon to electrically conductive lubricant can range from 10:1 to 3:1 by weight. The mixing of the solid lubricant, carbon (if used), and polymer-based binder is carried out according to conventional procedures for adding graphite, carbon black or other additive when preparing conventional resistive inks. The preferred solid lubricant is graphite intercalated with $CdCl_2$ which is available from Intercal Company (Port Huron, Mich.). One such intercalated graphite is a powder made by Intercal Company (DP 26121) having an average particle size of 88 microns. Average particle sizes for the intercalated graphite powder are preferably within the range of 100 to 15 microns or less. $CrCl_3$ intercalated graphite powder having average particle sizes of about 15 microns is available from Intercal Company as Intercal SP 13030. Smaller particle size intercalated graphite is even more desirable to produce resistive inks with more uniform resistivity and surface finish. Intercalated graphite having an average particle size of 0.8 microns is available from the Intercal Company (e.g. DP 51011 having $NiCl_2$ intercalant). However, the thermal stability of the intercalated graphite is dependent on both the intercalant and the particle size of the powder, with larger particles providing higher thermal stability. Therefore, the optimum intercalated graphite for the present resistive ink must be selected to take into account the intercalant used and the particle size of the powder to obtain the desired thermal stability.

The thickness of the resistive ink coating applied to the potentiometer element is preferably between about 0.0005 inch (0.0012 cm) to 0.005 inch (0.013 cm). Other film thicknesses may be utilized where potentiometer design requires an increased resistive ink film thickness. In adding the solid lubricant to the carbon/polymer resin, it is necessary to ensure that uniform distribution of the solid lubricant throughout the resin is accomplished. Further, the uniform distribution of the lubricant must be maintained during addition of the diluent (solvent). Uniform distribution of the solid lubricant insures that continual lubrication will be provided during operation of the potentiometer as the resistive ink is gradually worn by continued wiper contact. This insures that the resistive ink maintains its self-lubricating properties throughout the potentiometer's useful life.

The resistive ink of the present invention is capable of effective operation under any low humidity conditions, which include spaceborne and terrestrial applications. With regard to the latter, the resistive ink of the present invention can perform effectively under low moisture conditions in air, as well as under vacuum conditions. The resistive ink of the present invention has the additional advantage that it is thermally and environmentally stable within the widest possible operating range of potentiometers used for spaceborne and terrestrial applications, namely from about −200° C. to about +250° C.

Examples of practice are as follows:

EXAMPLE 1

Intercal DP 26121 ($CdCl_2$) is mixed with DAP RESIN to provide a resin having 40 weight percent INTERCAL DP 26121 and 60 weight percent DAP. The DAP is obtained from the Rogers Corporation, Manchester, Conn. Toluene is added to the resin mixture in an amount sufficient to reduce the viscosity to a level suitable for spraying, i.e. passing through a number 2 Zahn cup in approximately 20 seconds. The mixing is accomplished by ball milling procedures conventionally employed for making resistive paints. After sufficient toluene has been added to reach the desired paint viscosity, the paint is sprayed onto a conventional potentiometer substrate made from DAP or phenolic plastic. The paint is then cured by heating at a temperature of about 300° C. for about 10–20 minutes under a pressure of 2000 to 4000 psi. The resulting cured resistive ink is self-lubricating at temperatures up to about 300° C. and under vacuum conditions up to $1\times10^{-9}$ torr or lower.

EXAMPLE 2

A phenolic resin meeting the requirements of MIL-R-3043B (Military Specification, Resin Coating, Permanent, for Engine Components and Metal Parts) is mixed with $MoSe_2$ in the following amounts: 70 weight percent phenolic resin and 30 weight percent $MoSe_2$. The $MoSe_2$ is a powder having an average particle size of about 4–10 microns. The resin and powder are mixed for a sufficient time to achieve a uniform mixture. Toluene is then added to achieve an ink which passes through a number 2 Zahn cup in about 20 seconds. The resulting ink is sprayed onto a conventional phenolic potentiometer substrate to provide a coating which is approximately 0.001 inch (0.002 cm) thick. The coating is cured at a temperature of about 150° C. for about 1 hour. The resulting resistive ink is stable up to temperatures of about 200° C. and remains electrically conductive and lubricative at high vacuum conditions up to $1\times10^{-9}$ torr.

EXAMPLE 3

The same procedure is followed as in Example 1, except that Intercal SP 13030 ($CrCl_3$) is substituted as the solid lubricant in the formulation. The resulting resistive ink has lower thermal stability than the ink formed in Example 1, but can be formulated to have improved lubricious properties.

EXAMPLE 4

In this example, the same process is followed as in Example 1 except that sufficient carbon powder is added to give a formulation of 10 weight percent Intercal DP 26121, 30 weight percent carbon powder and 60 weight percent DAP. The addition of the carbon powder allows the electrical properties of the resistive ink to be tailored to meeting specific requirements, by proper selection of the grade and particle size of the carbon powder.

EXAMPLE 5

In this example, the same procedure is followed as in Example 4, except that Intercal SP 13030 is substituted for Intercal DP 26121. The resulting ink has lower thermal stability but better lubricious properties than the ink of Example 4.

EXAMPLE 6

In this example, the same procedure is followed as in Example 4, except that Intercal DP 51011 ($NiCl_2$) is substituted for Intercal DP 26121. The DP 51011 has improved processing characteristics, such as fine particle size and ease of mixing, but forms an ink having lower thermal stability than the $CdCl_2$ and $CrCl_3$ of Examples 4 and 5, respectively.

Having thus described exemplary embodiments of the present invention, it should be noted by those skilled in the art that the within disclosures are exemplary only, and that various other alternatives, adaptations and modifications may be made within the scope of the present invention. Accordingly, the present invention is not limited to the specific embodiments as illustrated herein, but is only limited by the following claims.

What is claimed is:

1. In a potentiometer having an electrical contact wiper which rubs against a resistive element made from a resistive ink comprising a polymer, wherein the improvement comprises incorporating into said resistive ink a solid lubricant which remains electrically conductive and lubricious under low moisture and high vacuum, said solid lubricant being selected from the group consisting of $MoSe_2$, $NbSe_2$, graphite intercalated with bromine and graphite intercalated with a metal chloride selected from the group consisting of $CdCl_2$, $CrCl_3$, $NiCl_2$, and $CuCl_2$, and the weight ratio of said polymer to said solid lubricant being within the range of about 5:1 to 1:1, to thereby reduce wear of the electrical contact wiper under low moisture and high vacuum conditions.

2. An improved potentiometer according to claim 1 wherein said resistive ink further comprises carbon.

3. An improved potentiometer according to claim 2 wherein the weight ratio of said carbon to said electrically conductive solid lubricant is within the range of 10:1 to 3:1.

4. An improved potentiometer according to claim 1 wherein the polymer is selected from the group of resins consisting of diallylphthalate resins, phenolic resins, epoxy resins, acetal resins, and acrylic resins.

5. An improved potentiometer according to claim 1 wherein said polymer is a diallylphthalate resin.

6. An improved potentiometer according to claim 5 wherein said solid lubricant is graphite intercalated with $CdCl_2$.

7. An improved potentiometer according to claim 5 wherein said solid lubricant is $MoSe_2$.

8. An improved potentiometer according to claim 1 wherein said solid lubricant provides lubricity over the temperature range from about −200° C. to about +250° C.

* * * * *